US006134804A

United States Patent [19]

Oechsle et al.

[11] Patent Number: 6,134,804

[45] Date of Patent: Oct. 24, 2000

[54] TOTAL RESTRAINT DRYING

[75] Inventors: Markus Oechsle, Bartholomae, Germany; Gunter Halmschlager, St. Poelten, Austria

[73] Assignee: Voith Sulzerpapiermaschinen GmbH, Germany

[21] Appl. No.: 09/120,524

[22] Filed: Jul. 22, 1998

Related U.S. Application Data

[60] Provisional application No. 60/053,446, Jul. 23, 1997, and provisional application No. 60/066,200, Nov. 19, 1997.

[51] Int. Cl.[7] ..... F26B 13/30

[52] U.S. Cl. ..... 34/114; 34/117; 34/120

[58] Field of Search ..... 34/116, 117, 120, 34/121, 123, 126, 124, 115; 162/306, 359.1, 193

[56] References Cited

U.S. PATENT DOCUMENTS

| | | | |
|---|---|---|---|
| 4,359,827 | 11/1982 | Thomas | 34/452 |
| 4,876,803 | 10/1989 | Wedel | 34/117 |
| 4,905,379 | 3/1990 | Wedel | 34/452 |
| 4,934,067 | 6/1990 | Wedel | 34/457 |
| 5,065,529 | 11/1991 | Skaugen et al. | 34/117 |
| 5,101,577 | 4/1992 | Wedel | 34/114 |
| 5,144,758 | 9/1992 | Skaugen et al. | 34/117 |
| 5,146,696 | 9/1992 | Mayer et al. | 34/117 |
| 5,175,945 | 1/1993 | Skaugen et al. | 34/117 |
| 5,205,052 | 4/1993 | Kraft et al. | 34/114 |
| 5,279,049 | 1/1994 | Skaugen et al. | 34/115 |
| 5,299,363 | 4/1994 | Kraft et al. | 34/117 |
| 5,311,672 | 5/1994 | Kotitschke et al. | 34/117 |
| 5,341,579 | 8/1994 | Schiel et al. | 34/115 |
| 5,388,347 | 2/1995 | Kerttula et al. | 34/457 |
| 5,507,104 | 4/1996 | Skaugen et al. | 34/117 |
| 5,542,193 | 8/1996 | Sims et al. | 34/117 |
| 5,743,024 | 4/1998 | Oechsle | 34/447 |

*Primary Examiner*—Pamela A. Wilson
*Attorney, Agent, or Firm*—Graham & James LLP

[57] ABSTRACT

The present invention relates to the dryer section of a paper machine consisting of a number dryer groups having dryer cylinders and one reversal role between each two dryers within a dryer group. The dryer section may have top felted or bottom felted dryer groups. A differential pressure box may be placed between the dryer cylinders and above the reversal roles in a top-felted dryer group and between the dryer cylinders and below reversal roles in a bottom felted dryer group. Between dryer groups the transfer between top felted dryer groups can occur with either an open or closed draw. The transfer between a top felted dryer group and a bottom felted dryer group occurs with an open draw. The size of the draw can be adjustable by making one or both of the guide rolls at the transfer moveable.

19 Claims, 15 Drawing Sheets

TOTAL RESTRAINT DRYING

This application claims the benefit of U.S. Provisional Application No. 60/053,446, filed Jul. 23, 1997 and No. 60/066,200, filed Nov. 19, 1997.

BACKGROUND OF THE INVENTION

The present invention relates to a machine for producing a fiber web, particularly a paper web, and particularly relates to the dry end of the machine. The machine has a press section followed in the web path by a dryer section. The dryer section comprises a plurality of separated dryer groups, each operable at a respective different speed. Each dryer group includes a plurality of dryers, a plurality of web path reversal rolls, one between each two dryers, and an endless loop web support belt, which is sometimes a dryer felt, passing around the dryer group in a meander path past the dryer cylinders and the reversal rolls and past guide rolls which guide the support belt in the endless loop. The pocket between the dryer cylinders may have a differential pressure box within it. After the web to be produced from a fiber suspension is formed and partly dewatered in a wire end or forming end or wet end of the machine, the web is dewatered mechanically as far as possible in a press. Then the web is dried in a dry end comprised of heatable drying cylinders.

In the prior art single tier dryer sections, the web is restrained while travelling around the dryer cylinder by having a felt press the web against the dryer cylinder. Between dryer cylinders, a vacuum roll was located to restrain the web against the felt during passage around the vacuum roll and thereby restraining the web against cross-machine directional shrinkage. However, the web is not restrained between the place where the web leaves the dryer cylinder and the place where the web is picked up by the vacuum roll.

In order to increase the runnability, it is known to keep the web as reliably as possible on the web support belt at the place where the web runs off from each individual drying cylinder to the reversing roll, and on the straight travel path from the reversing roll to the following drying cylinder. In this respect, the initial region of the dry end presents a particular problem because the paper web is still relatively wet there and it has a tendency to adhere to the wall of the drying cylinder and to detach itself temporarily from the support belt as the web leaves each dryer cylinder. In other words, a so called bubble is formed here between the web of paper and the support belt. In order to reduce the danger of the web of paper tearing, it is attempted to keep the bubble as small as possible. For this purpose, it is known to form a vacuum zone at the run-off place, shown in U.S. Pat. No. 4,359,828, FIG. 3. Another known measure to reduce the danger of the web of paper tearing consists of reducing the distance between the drying cylinder and the adjacent reversing roll as much as possible, shown in International Application WO 83/00514, FIG. 2, or U.S. Pat. No. 4,905, 379, FIG. 1.

SUMMARY OF THE INVENTION

The dryer section consists of a number of dryer groups having heatable dryer cylinders and one reversal roll between each two dryers within a dryer group. The dryer groups may be top-felted or bottom felted dryer groups. A differential pressure box may be placed in the top-felted dryer groups between the dryer cylinders and above the reversal rolls. A differential pressure box may be placed in the bottom-felted dryer groups between the dryer cylinders and below the reversal rolls.

Drive means for driving the drying cylinders and/or reversing rolls in each of the dryer groups rotates the dryers, and reversing rolls to move the web through the dryer group. Each of the drive means for each of the dryer groups has a drive which is adapted to produce a selectively variable rotation speed for the drying cylinders and/or reversing rolls in that dryer group, and a respective speed control device for the drying cylinders and/or reversing rolls of each of the dryer groups for enabling adjustment to produce a difference in rotation speeds between the drying cylinders of adjacent dryer groups.

In a further embodiment of the invention, at least in the dry end of the dryer section, an open unsupported paper path or open draw is present between two dryer groups. This not only favors the removal of longitudinal stresses, it takes into account that slight rotary oscillations can occur from time to time in the drive elements. These oscillations cause a danger of producing a sudden, abrupt increase in the longitudinal stress in the web of paper which may cause a tear of the web. However, this danger is avoided with the invention by providing open separation places, since a sudden increase in the longitudinal stress within a free path, and especially a relatively long free path of travel of the web of paper, is less dangerous than at a closed place of separation. The free path of travel of the web of paper preferably being between approximately six inches to approximately four feet. Further an open draw transfer between dryer groups allows for easy removal of broke between those dryer groups. At the open draw the broke is allowed to fall directly into the basement of the paper machine.

The invention can be used in connection with various different types of dry ends. However, all of them share the feature that they have exclusively or at least predominantly single tier dryer groups in the main dryer section. In a single tier drying group, all of the drying cylinders dry the same side of the web.

In one embodiment, a first drying section design with which the invention can be used has web turn over or web reversal separation places. In the dryer group at one side of such a separation place, one side, e.g. the bottom side, of the web is in direct contact with the drying cylinders. In the dryer group at the other side of that separation place, the opposite side of the web, e.g. the top side, is in direct contact with the drying cylinders. In this arrangement, the turn over separation places or web reversal transfer zones are open, i.e. at each separation place, the two web support belts do not travel a common path and the web is unsupported between the dryer groups. It is advantageous to modify the turn over separation places so that they have open draws. Various advantages are obtained:

1. At the turn-over separation places of the dry end, the danger of the support belts rubbing against each other and causing wear to each other if there is a difference in speed between them is avoided. This danger is present when the support belts contact each other at the turn over separation places when such a machine is temporarily operating without a paper web. This danger is present continuously and in normal operation at the edges of the support belts since the width of the support belts is greater than the width of the web of paper between the belts.

2. Between two dryer groups along the web path, a positive difference in speed can be established. The positive difference in speed is preferably at the wet end of the dryer section.

This makes it possible to pre-stress the web at the turn over separation place.

3. Also, at the separation places in the dry end at which there may be no difference in speed between successive dryer groups or a small negative draw, it is advantageous to provide relatively long free web travel so as to prevent the above described danger of tears resulting from occasional oscillations in the rotation of the drive elements.

4. The open draw allows a place for broke to freely fall into the basement of the paper machine.

5. The open draw allows the web to relax and not be under the stress of being held by a closed draw transfer. Because the web is constantly shrinking as it dries, if the web is restrained excessively, beyond the web's breaking point or stretch capabilities, it will tear. Therefore an open draw transfer allows the web a chance to recover from the stress of restrained drying.

In a further embodiment, the dry end design has all top-felted single tier dryer groups wherein the drying cylinders of all of the dryer groups are arranged above the respective reversal rolls between adjacent drying cylinders. The transfers between top-felted dryer groups in accordance with the invention can be developed as open or closed separation places for the reasons explained above. Whether the separation spaces should be developed open depends on the type of paper being dried or on the moisture content still present in the web at the place of separation, and furthermore on the magnitude of the speed difference to be adjusted between dryer groups. In many cases, it is entirely possible to keep a separation place closed despite a required difference in speed between two dryer groups. One can imagine that following the place of run off of the preceding web support belt from the last cylinder of the preceding dryer group, up to contact with the succeeding web support belt of the following dryer group, the web detaches itself slightly from the last drying cylinder since a thin layer of vapor forms between the last drying cylinder and the web. Furthermore, the web initially only has loose contact with the support belt of the following dryer group. This contact only becomes more secure at the place where the support belt and the supported web reach the first reversal roll of the following dryer group. It is possible that the speed of the support belt of the following dryer group may differ by a small amount from the speed of the support belt of the preceding dryer group. This means that the web moves at different speeds in the preceding and following dryer groups. However, because small and sudden changes in speed must be expected from time to time, the resulting danger of a tear can be reduced if the "simple" separation places are also developed as open separation places.

In certain cases, it may be advantageous to operate a separation place at times open and at times closed. For this purpose, one of the guide rolls over which the support belt of the following dryer group travels can be movably supported.

In another type of construction of the dry end to which the invention can be applied, the drying cylinders of all of the dryer groups are arranged above the respective reversal rolls between adjacent drying cylinders. It depends on the individual dry end and the nature of the paper web to be produced whether it is better to operate the separation places open or closed. As a rule, however, it will be advantageous to provide open separation places between the dryer groups at least in the final end region of the dry end where the residual moisture content is already very slight. Stated more precisely, at least the last separation place, or the last two or three separation places, are developed as open separation places. On the other hand, in the upstream region of the dry end, it is usually more advantageous to develop the simple separation places as closed separation places. Again it is advisable, at least in connection with some of the separation places, to provide for the possibility of changing from an open separation place to a closed separation place, or vice versa.

At a separation place which is developed as an open separation place according to the invention, the web of paper travels across the separation place over a free travel path from the last drying cylinder of the preceding dryer group to the support belt or dryer of the following dryer group. The advantages of this measure are identical or similar to those in the case of the dry end constructions described further above. Better handling of paper web shrinkage during progressive drying can be done by driving the following dryer group with a slightly lower speed than the preceding dryer group especially in the dry end of the dryer section. If both dryer groups were driven continuously at the same speed, then longitudinal stress would be built up in the web of paper due to its shrinkage upon drying. In the extreme case, together with other disturbing factors, this might cause a tear in the web of paper. However, if necessary, a slight positive draw can also be run between two dryer groups across an open draw in order to create tension in the web so the web does not flutter across the open draw especially in the wet end of the dryer section. Since the web is constantly shrinking as it progresses downstream, a transfer without any draw still is done under tension between the dryer groups.

Driving the two dryer groups in question with a slightly different speed can be attempted even if the place of separation between them is closed. However, at the place where the paper web contacts the last drying cylinder of the preceding dryer group and the support belt of the following dryer group, there is a danger that the surface of the web will be damaged due to the difference in support belt speeds. There is the further factor that in the respective drives for each of the dryer groups of the dry end, as already mentioned, oscillations in drying cylinder rotation sometimes occur. These are more likely to cause a tear of the paper web at a closed separation place than at an open separation place.

In a further embodiment, the use of vacuum rolls, reversal rolls, i.e. having a perforated cylinder, with pressure differential boxes adjacent, reversal rolls having a perforated cylinder or grooved rolls are varied by dryer group depending on the moisture content of the paper and the type of paper being made. In one embodiment, in the early dryer groups perforated cylinders with pressure differential boxes, above or below the cylinders are used. This is because the greatest water content is present in the web. This high water content in the web causes a bubble in the web when it leaves a heated surface of the dryer cylinder. In order to assist the web in removing the bubble, a draw is created between the dryer cylinder and the perforated cylinder. This draw allows pressure differential forces created by the pressure differential boxes and other forces acting on the web to pull the bubble out of the web. In the prior art, a short draw of 2–4" between the dryer cylinder and vacuum roll, does not provide a large enough area and enough time for the dryer group to work the bubble out before the paper is held to a vacuum roll. This causes wrinkling or creping of the paper.

In later groups of the dryer section, reversal rolls having perforations or circumferential grooves, but no means for creating a vacuum are provided. This is because at the dry end of the dryer section, the paper has a low moisture content, it needs a chance to relax and relieve longitudinal stresses. Therefore only perforated reversal rolls or rolls having circumferential grooves are necessary between dryer cylinders within a dryer group.

In a further embodiment of the invention a transfer between a top felted and a bottom felted dryer group is described wherein at the transfer there are no rolls between the dryer cylinders of the two dryer groups. The transfer occurs directly from one dryer cylinder of a first dryer group to a dryer cylinder of a following dryer group.

Other objects, features and advantages of the present invention will become apparent from the following description of the invention which refers to the accompanying drawings.

DESCRIPTION OF THE PREFERRED EMBODIMENTS

Figure 1A:
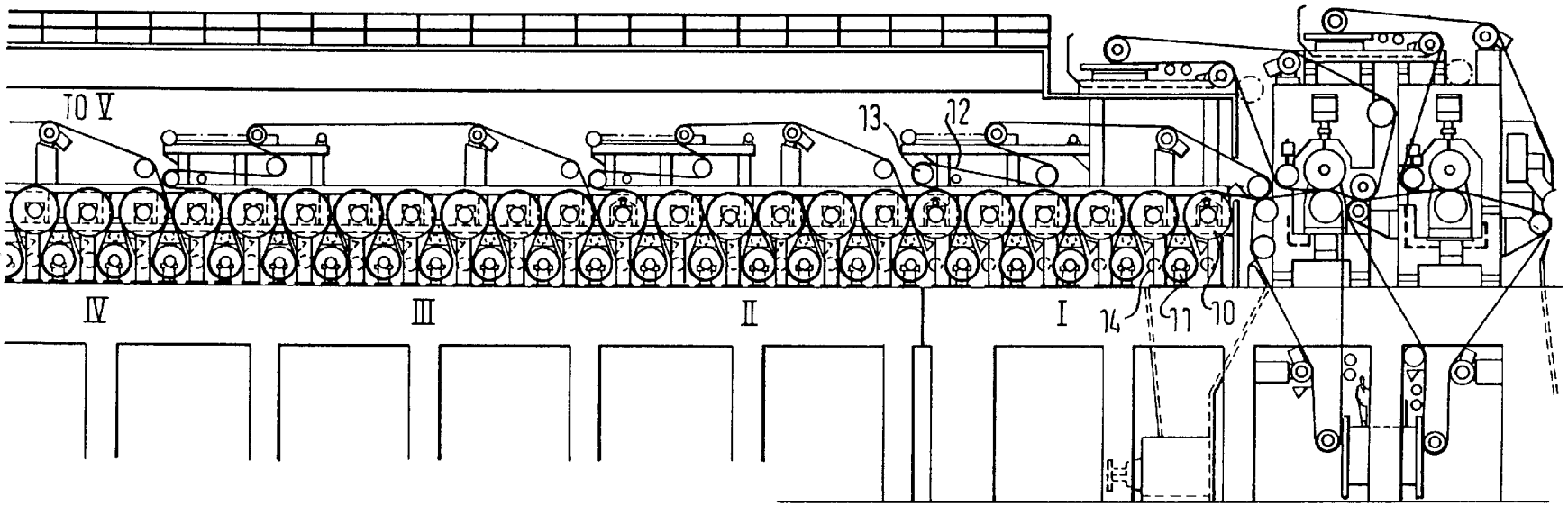
FIGS. 1A and 1B diagrammatically show a dry end of a paper manufacturing machine in which a mixture of top and bottom felted dryer groups are arranged.
Figure 1B:
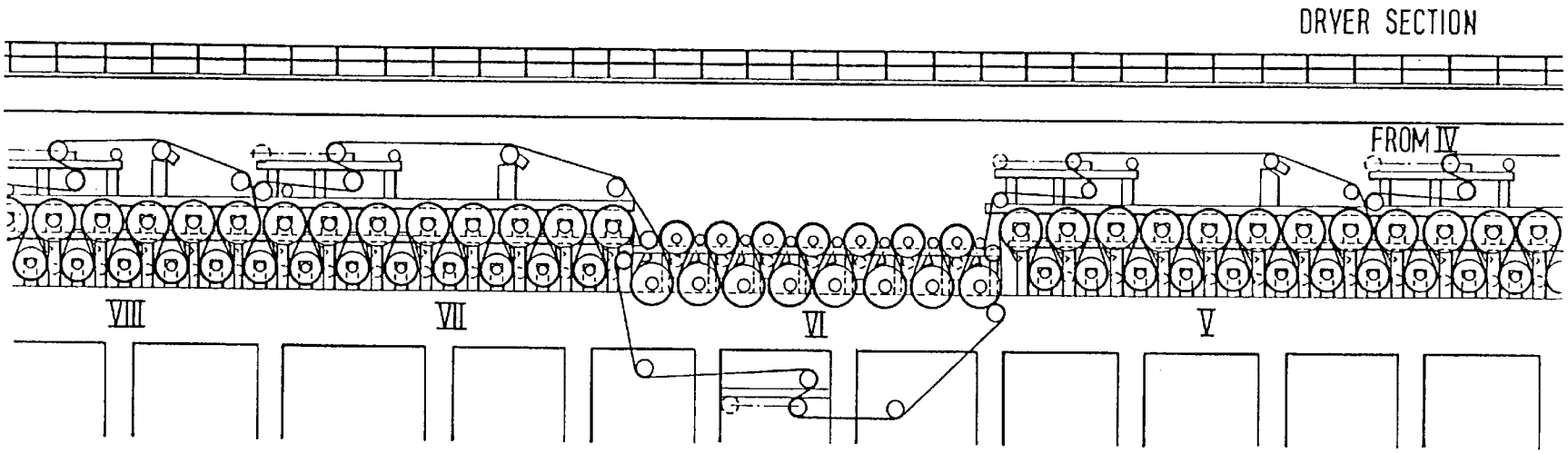

In FIGS. 1(A) and 1(B), the dry end following the press section comprises eight dryer groups I to VIII. Each dryer group has its own respective web support belt 12 and has a plurality of drying cylinders 10 which alternate with a respective reversal roll 11 and a pressure differential box 14 between adjacent drying cylinders 10 within each dryer group. As shown in FIG. 1, these reversal rolls 11 are perforated cylinders. Furthermore, there are guide means comprising guide rolls 13 for guiding, tensioning and regulating each endless loop support belt 12. Horizontal rows of drying cylinders 10 are shown. However, vertical or inclined rows of cylinders can also be provided. Each of the dryer groups I to VIII has its own respective drive.

In one embodiment, as shown in FIG. 1(B) in many of the dryer groups throughout the dryer section, and all the dryer groups in the initial, or upstream or wetter region of the dryer section, only the lower side of the web comes into contact with the drying cylinders 10. In other words, in most of the dryer groups, the drying cylinders 10 all lie above the neighboring reversing rolls 11 with which the dryer cylinders 10 alternate along the web path. Only the second to the last dryer group, VI, for instance, has a reverse arrangement in which the drying cylinders 10 lie below the reversing rolls 11 so that the top side of the paper web comes into direct contact with the drying cylinders 10 of that group. It is preferred that reversing rolls 11 as shown in FIG. 1 are perforated cylinders. Reversing rolls 11 can also be vacuum rolls or grooved cylinders. Between the dryer cylinders 10 and above the reversal rolls 11 in dryer groups I, II, III, IV, V, VII and VIII is located a pressure differential box 14. Between the dryer cylinders 10 and below reversal rolls 11 in dryer group VI is located a pressure differential box 14. This is preferably a Duostabilizer or vacuum box, however, other pressure differential boxes, such as blow boxes may also be used. Boxes having no means of creating a pressure differential, but that can divert the air currents associated with the movements of the web can also be placed in the pocket.

Accordingly, within the initial region of the dry end, for instance between each two of the first five dryer groups, there are only so called "simple" places of separation between the adjacent dryer groups. This means that the web support belt 22 of the next following succeeding dryer group contacts the last drying cylinder 10 of the preceding dryer group at a place where the web of paper is no longer covered by the web support belt 12 of the preceding dryer group. Such a known development of the place of separation is advantageous in two respects. The threading of the web of paper, for instance upon the starting of the paper machine operation or after a tear of the paper web, takes place completely automatically, without rope guidance being necessary, as is required in older arrangements. The web of paper travels just as reliably during the normal operation of the dry end from each preceding dryer group to the following dryer group. In an exceptional case and despite the favorable manner of construction described above, if a tear should take place in the web of paper, then the reject paper or broke moves readily downward from ALL drying cylinders 10 of the dryer groups into the basement provided below the dry end.

In the dryer groups I, II, III, IV, V, VII and VIII, the drying cylinders 10 are above the adjacent, alternate in the web path, reversal rolls 11 so that within these dryer groups, only the bottom side of the paper web comes into direct contact with the drying cylinders 10. The top side of the web rides on the outside of the support belt 12 around the rolls 11. In the dryer group VI, the drying cylinders 10 lie below the reversal rolls 11 so that the opposite top side of the web come into contact with the drying cylinders 10. Between dryer groups V and VI and VI and VII, all separation places between two adjacent dryer groups are developed as turn over or web side reversal separation places. At all of these turn over separation places, the web of paper travels over a free path of travel or open draw from the web support belt 12 of the preceding dryer group to the dryer cylinder 10 of the following dryer group. Here, all separation places are developed as open separation places. In FIG. 1(A) the open draw is approximately three feet, however the open draw preferably can vary from one to four feet. In a preferred embodiment as shown FIG. 1(B) no rolls other than the guide rolls are placed at the transfer between dryer groups V and VI and VI and VII. However, vacuum rolls, blow boxes, vacuum boxes and other devices which assist in transferring the web between dryer groups can be used. Further it is possible to change the distance of the open draw by making either or both guide rolls 13 or 23, supported to be moveable. The distance of the open draw could be decreased during threading and increased during operation of the paper machine. The distance of the open draw can be varied according to the type of paper and moisture content of the paper.

Figure 2A:
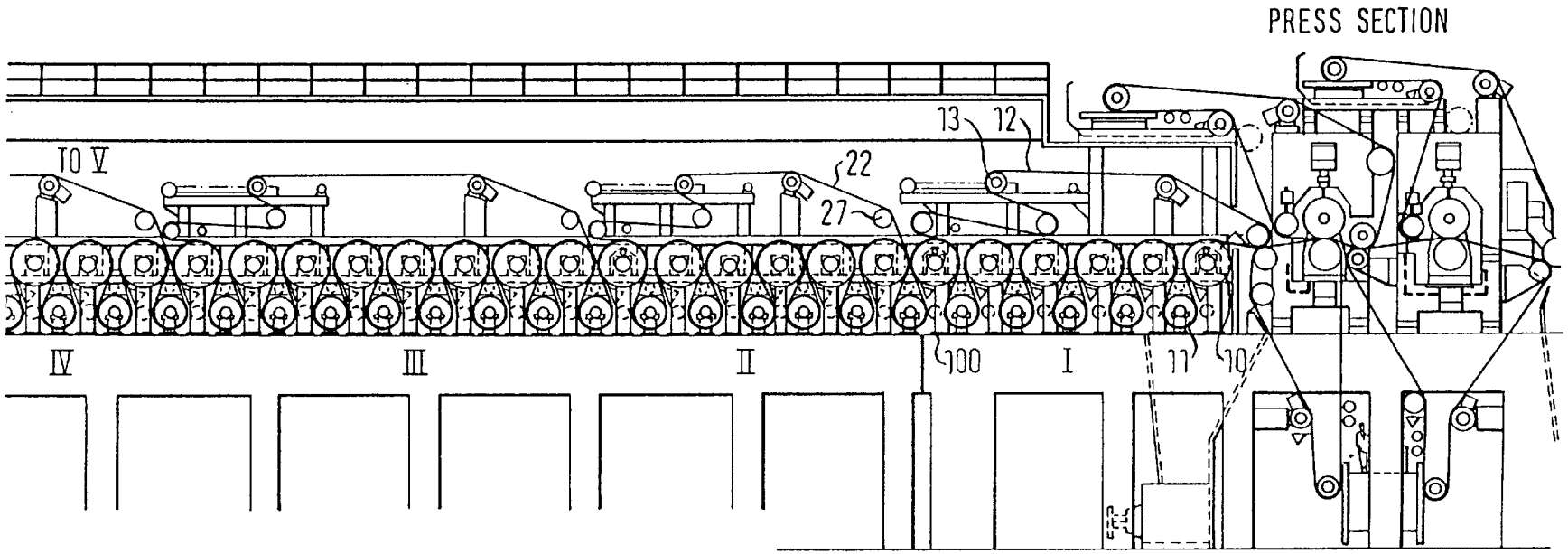
FIGS. 2A and 2B diagrammatically show the dry end of a paper manufacturing machine in which all the dryer groups are top-felted.
Figure 2B:
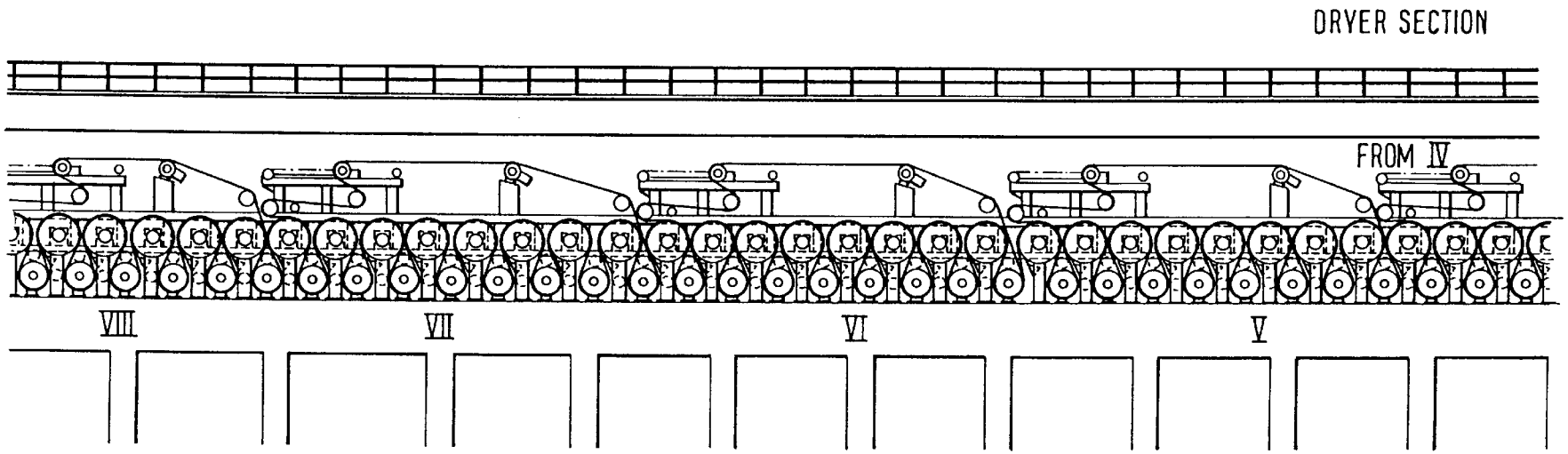

In an embodiment shown in FIGS. 2(A) and 2(B), the drying cylinders 10 are arranged above the reversal rolls 11 in all of the dryer groups I–VIII. Accordingly, only the bottom side of the web comes into contact with the drying cylinders 10 within the entire dry end. The separation places present within the dry end are therefore developed as so called "simple" separation places. This means, for instance, that at the separation place 100, the support belt 22 of the following dryer group II contacts the last drying cylinder 10 of the first dryer group I. That support belt 22 wraps around that cylinder 10 to a greater or lesser extent. This contact takes place at the point where the web of paper is no longer covered by the first support belt 12. This, therefore, is a "closed simple" separation place. For the above indicated reasons, an "open simple" separation place can also be provided. Here, a guide roll 23 and the first reversal roll 11 for the support belt 22 of the second dryer group II would be arranged behind the last drying cylinder 10 of the first dryer group I so that the support belt 22 passes at a slight distance away from the drying cylinder 10. Finally, it is possible to operate a simple separation place optionally either open or closed by displacing a guide roll 23. The guide roll 23 would be supported to be moveable.

Figure 3:
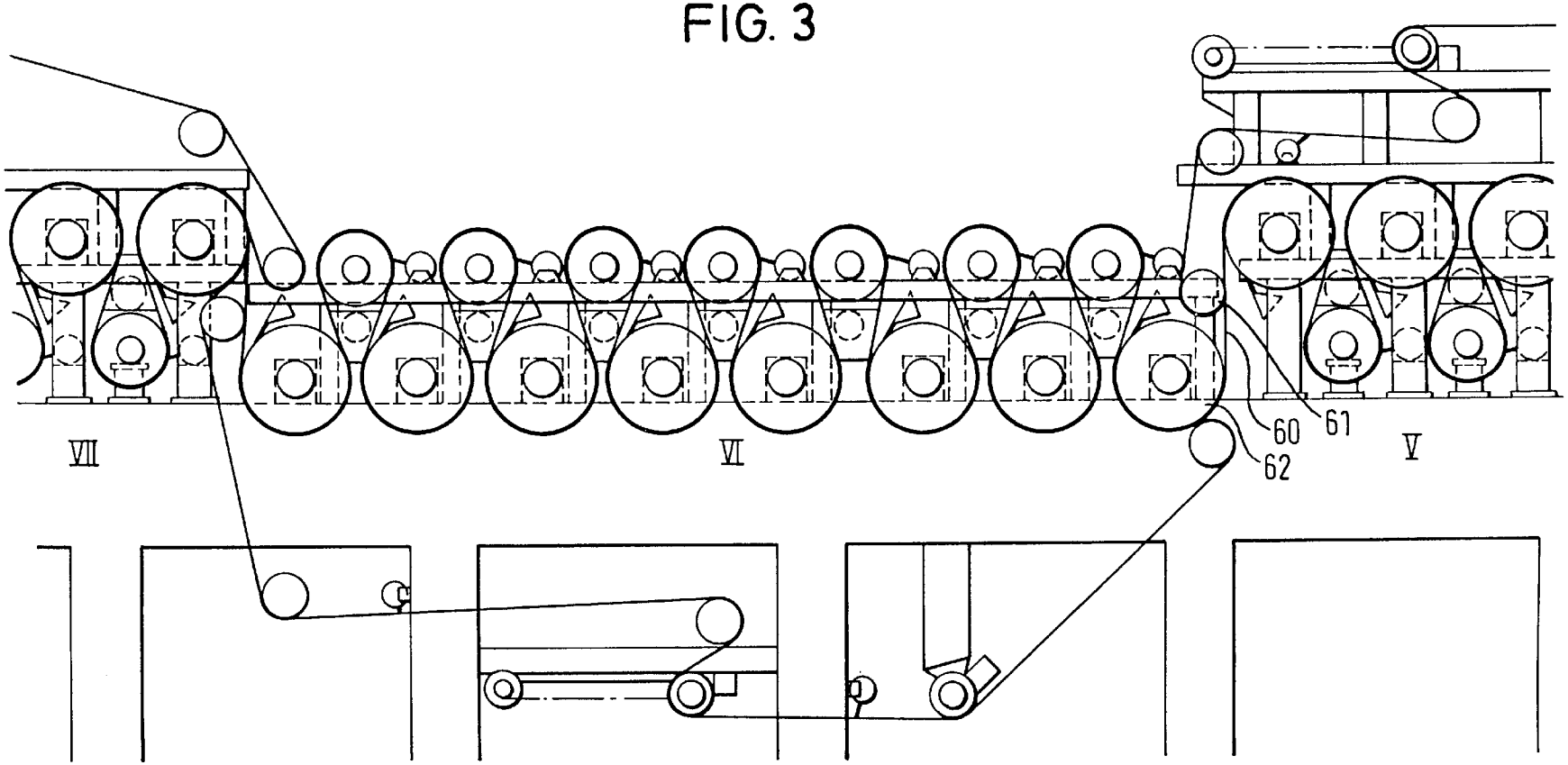
FIG. 3 shows a transfer between a top and bottom felted dryer group as shown in FIG. 1 on a larger scale.

FIG. 3 shows an enlarged view of FIG. 1 at the transfers between the top-felted single tier dryer groups and the bottom felted single tier dryer group. There is an open draw transfer between the dryer group V and dryer group VI. The web 60 is totally unsupported between the guide roll 61 and the dryer cylinder 62. A similar open draw transfer occurs between dryer group VI and dryer group VII. The distance of the open draw is preferably between about six inches to about four feet. The open draw as shown in FIG. 3 is approximately three feet. As stated previously the guide rolls 61 and 63 can be made moveable so as to alter the distance of the open draw. This can assist in threading of the web. In order to control sheet flutter in the open draw the speed of the dryer groups on either side of the open draw can be set to create enough tension in the web to control the sheet flutter, but not enough tension to create breaks in the web.

Figure 4:
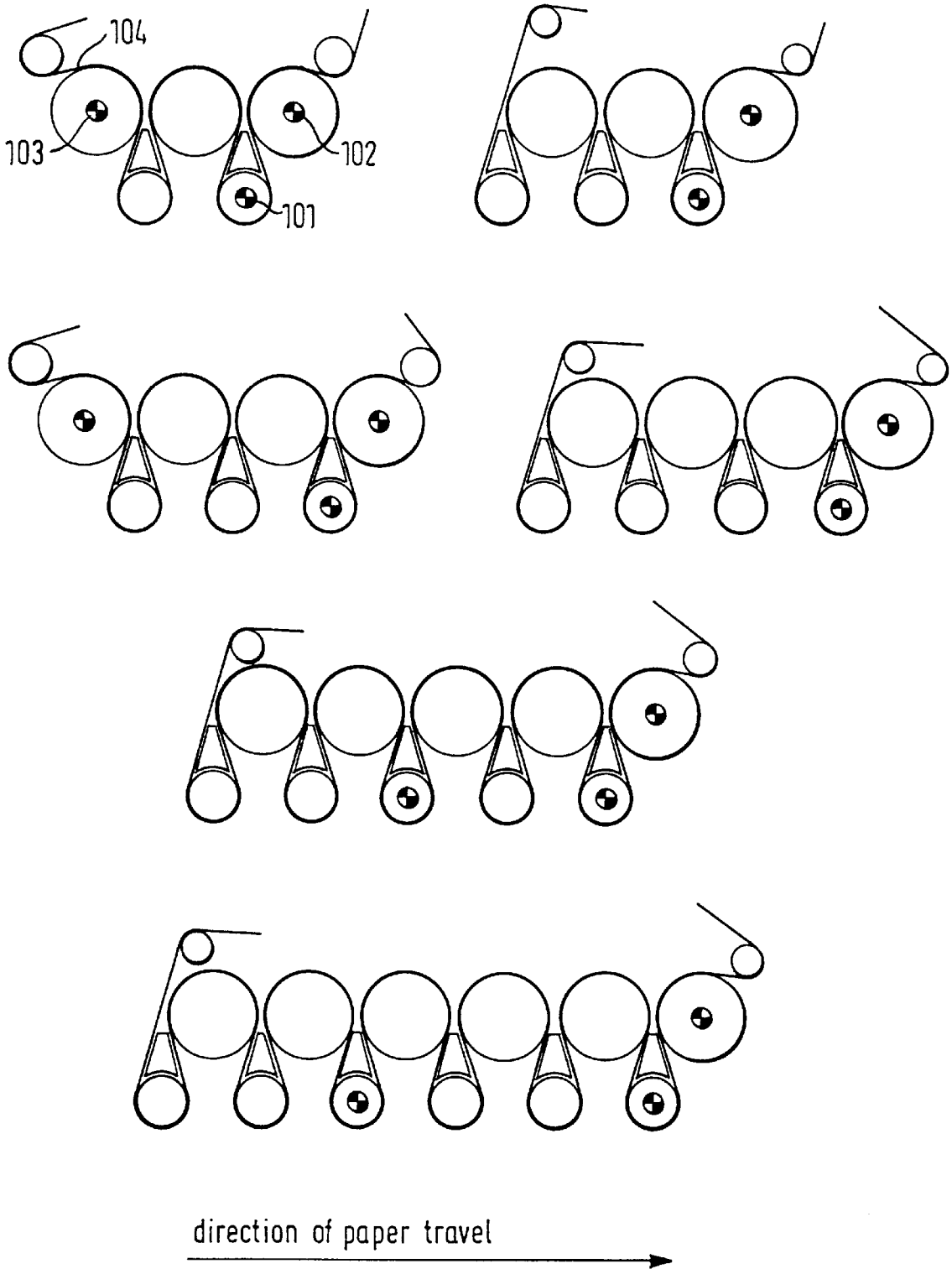
FIG. 4 shows drive arrangements in a single tier dryer group.
Figure 5:
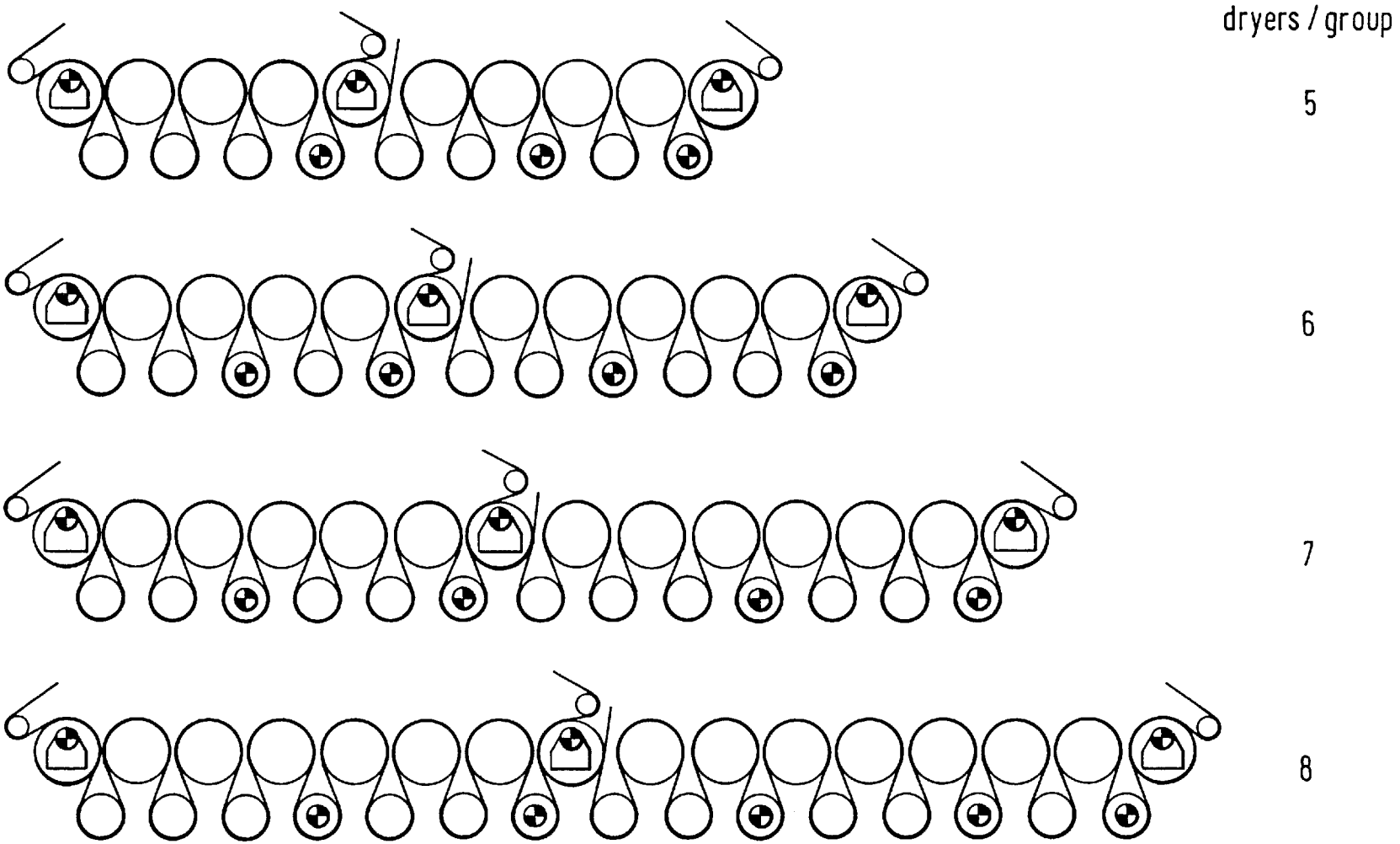
FIG. 5 shows drive arrangements in single tier dryer groups.
Figure 6A:
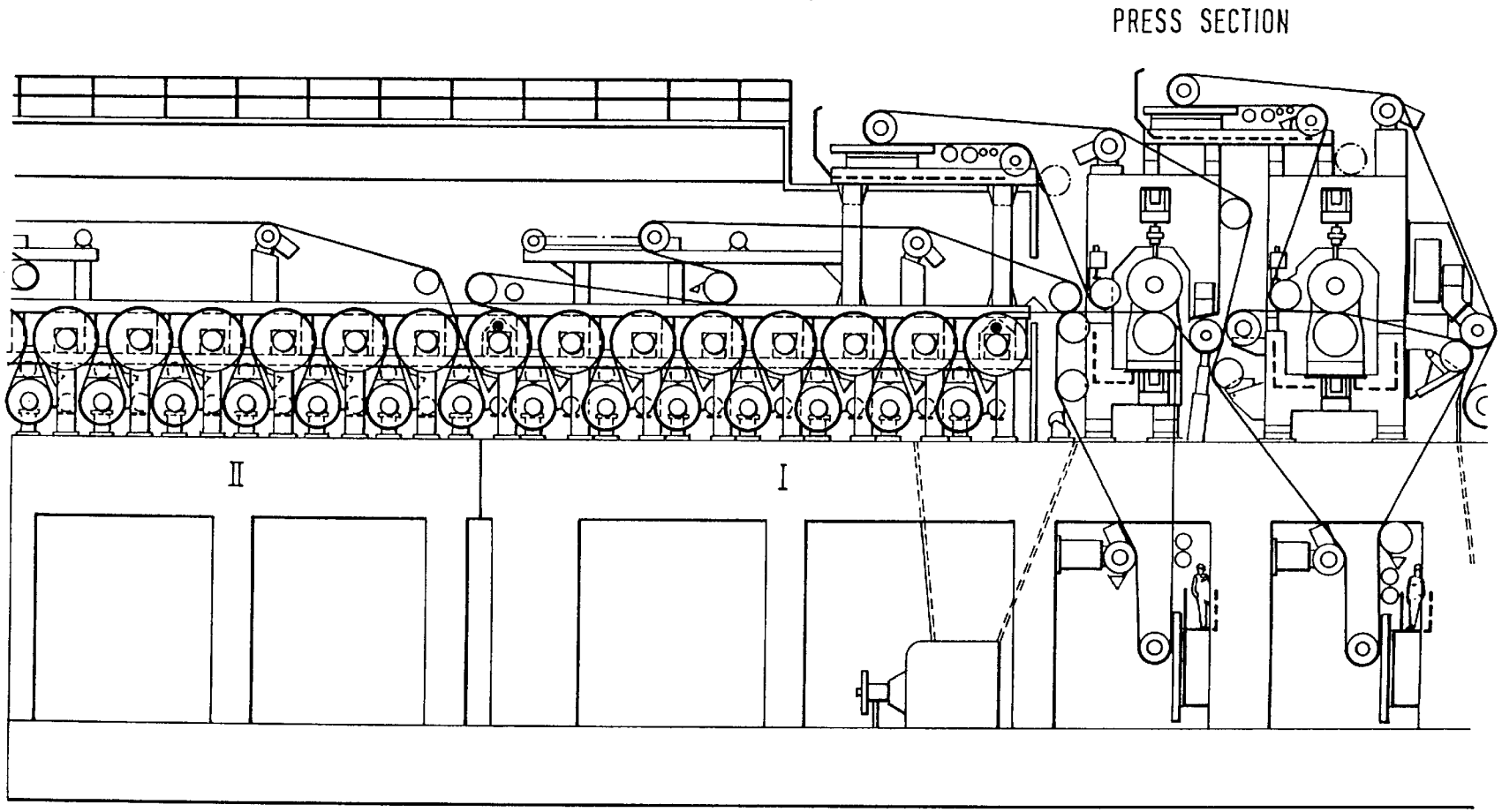
FIGS. 6A–6D diagrammatically show a dry end of a paper manufacturing machine in which a mixture of top and bottom felted dryer groups are arranged.
Figure 6B:
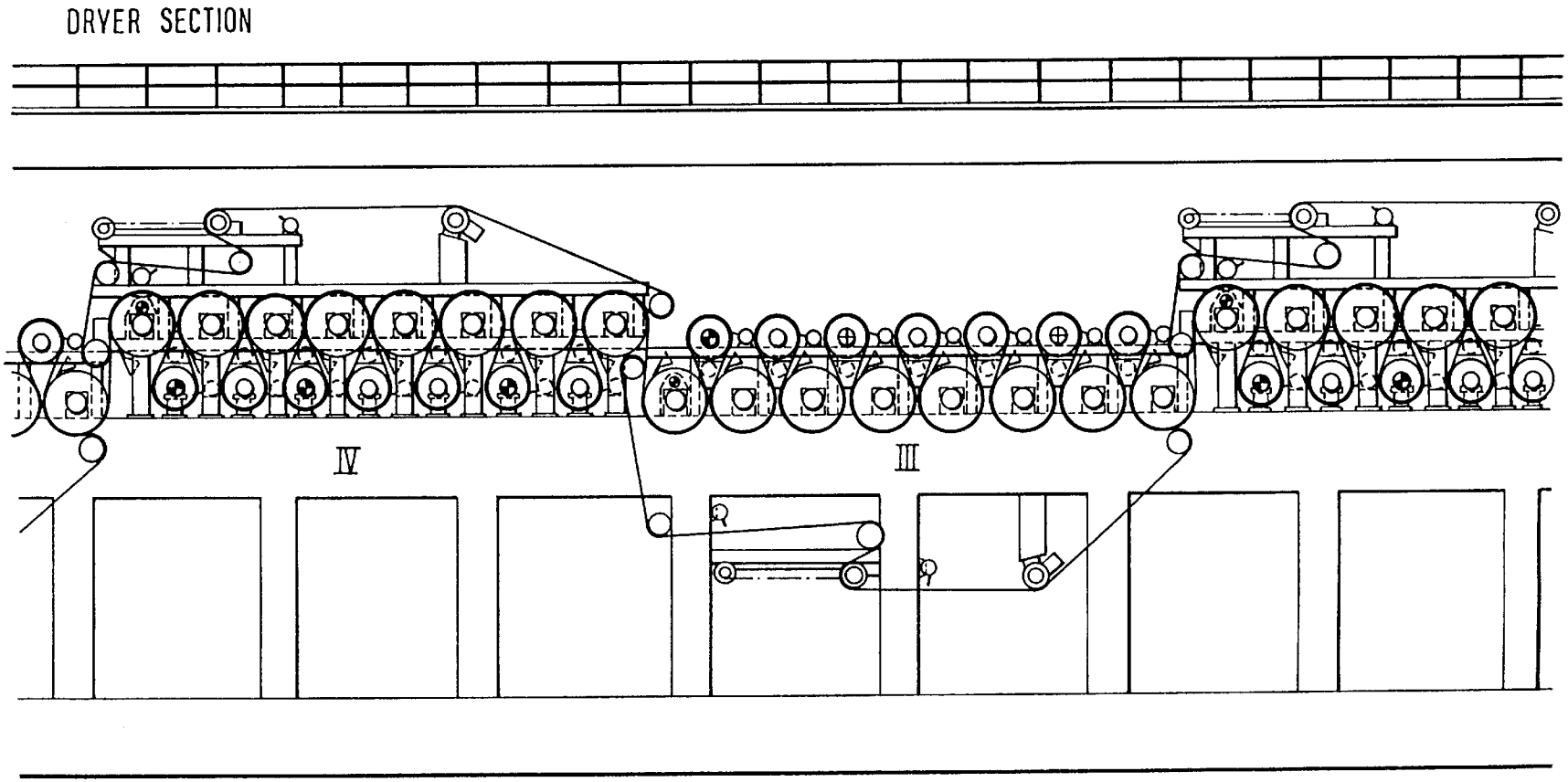
Figure 6C:
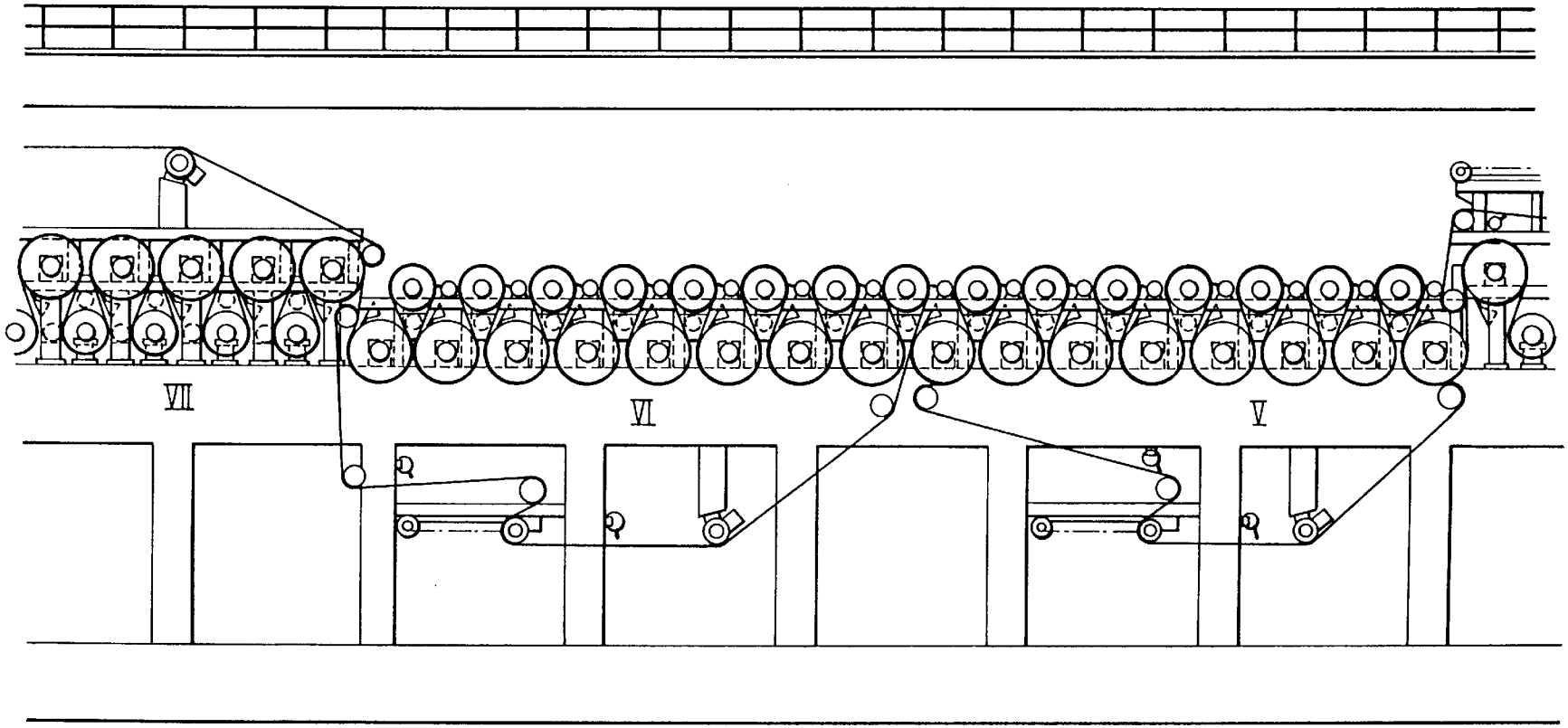
Figure 6D:
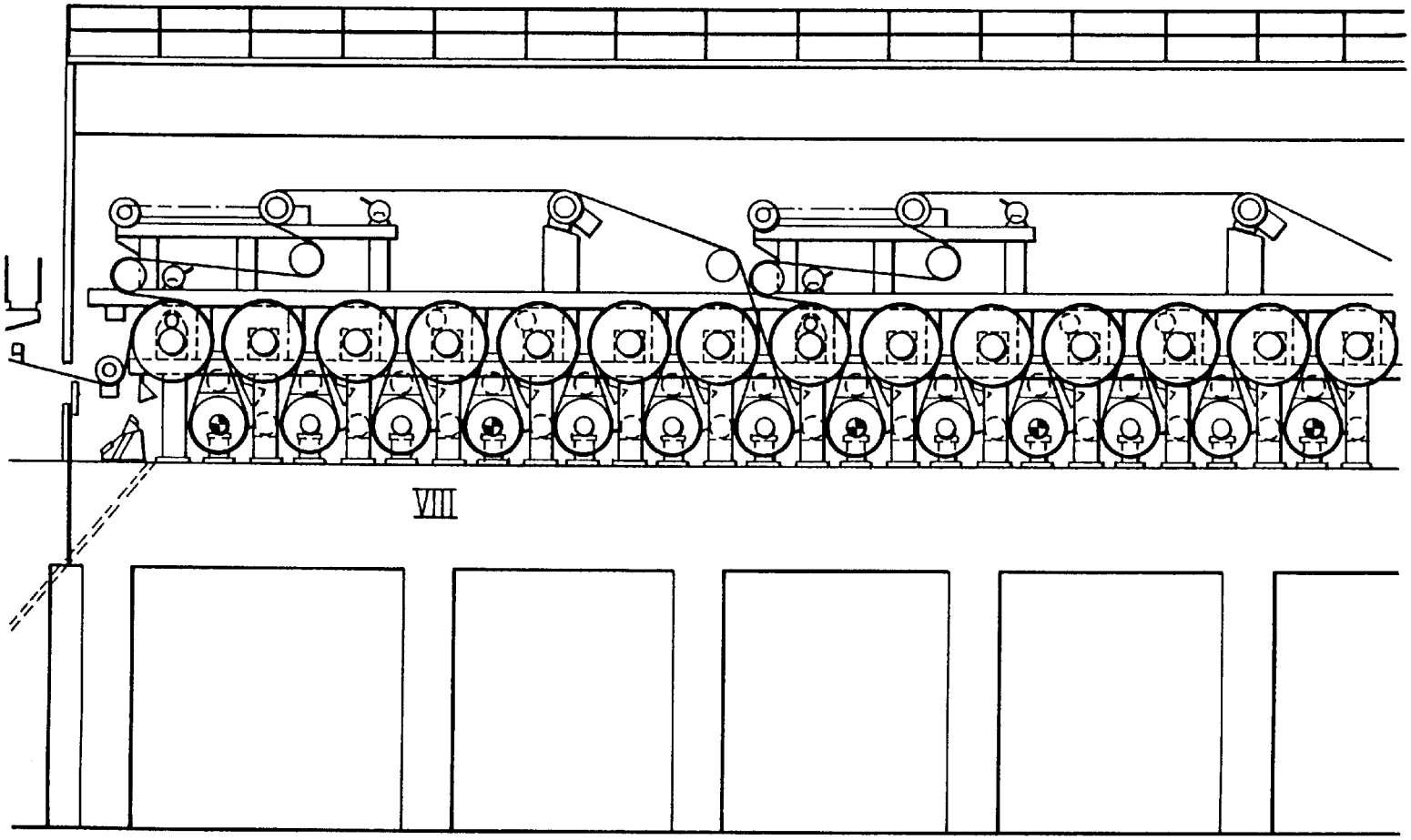

FIGS. 4 and 5 illustrate an embodiment of a drive concept that can be used with the dryer sections of this invention. As shown in FIGS. 4 and 5, there are no gear boxes. The dryer groups are driven by driving the reversing rolls 101. Because of the small wrap angle, the last dryer cylinder 102 of each dryer group is also driven. The first dryer cylinder 103 of each dryer group may also be driven because of the small wrap angle and because of the vapor layer created between the sheet and the dryer surface.

FIGS. 4 and 5 show the driven rolls 101 and driven dryers 102 or 103 of different size dryer groups. The drives for the reversing rolls 101 of a dryer group are equal. The drives of the driven dryers 102 or 103 of a dryer group are equal. The drives of the dryers 102 or 103 are smaller than the drives of the reversing rolls 101.

The drives of each dryer group are independently controlled. The drives of each dryer group, in turn, move the respective endless support belt 104. The web is moved by the driven support belts 104 and the speed of the drive units determines the speeds of the drying cylinders 102 and 103, of the support belts 104 and therefore of the web. The separation places between dryer groups make it possible for a certain difference in speed to be adjusted, at least on some of the separation places between the adjacent drive units. The speed of the dryer group refers to the speed of the web moving through the dryer group. A positive difference in speed can be provided, for example, between the first two dryer groups I and II as shown in FIG. 2 at the separation place 100. In other words, the web in the second dryer group II travels slightly faster than the web in the first dryer group I. Two adjacent dryer groups, for instance, groups II and III, can, if necessary, also be driven at the same speed, that is, the web travels at the same speed in both groups. The difference in speed between dryer groups is preferably only 1 to 3 feet per minute.

The web of paper has a tendency to adhere to the wall of each drying cylinder 10 at the runoff point from the individual drying cylinder 10 and therefore to temporarily detach itself from the respective support belt 12 of the dryer group. In order that the so called bubble produced at the run off place remain as small as possible, the drive for the first dryer group I is adjusted to a somewhat higher speed than the drive for the press section. Consequently, the web arrives at the runoff point with a certain longitudinal pre-tension. For the same reason, the drive for the second dryer group II can be driven with a somewhat greater speed than the drive for the first dryer group I. In order to make this possible, the first reversal roll II of the second dryer group II can be arranged at a distance from the support belt 12 of the first dryer group I. Accordingly, the paper web travels in a free travel path or open draw from the support belt 12 to the support belt 22. However, a small positive draw can still be created between dryer groups even if a closed draw is present.

Concerning the drives between dryer group VI and dryer group V of FIG. 1(B), dryer group VI can be run at a slightly greater speed than dryer group V to create sheet tension at the open draw transfer so that the sheet does not substantially flutter and cause the web to tear or break. Furthermore, there can be a positive speed differential between dryer group VII and dryer group VI, which also creates sheet tension in the web at the transfer between dryer group VI and VII.

As shown in FIG. 5, the dry end following the press section comprises eight dryer groups I to VIII. Each dryer group has its own respective web support belt 12 and has a plurality of drying cylinders 10 which alternate with a respective reversal roll 11 and a pressure differential box 14 between adjacent drying cylinders within each dryer group. As shown in FIGS. 6(A–D), these reversal rolls are perforated cylinders. Furthermore, there are guide means comprising guide rolls 13 for guiding, tensioning and regulating each endless loop support belt 12. Horizontal rows of drying cylinders 10 are shown. However, vertical or inclined rows of cylinders can also be provided. Each of the dryer groups I to VIII has its own respective drive.

Figure 7:
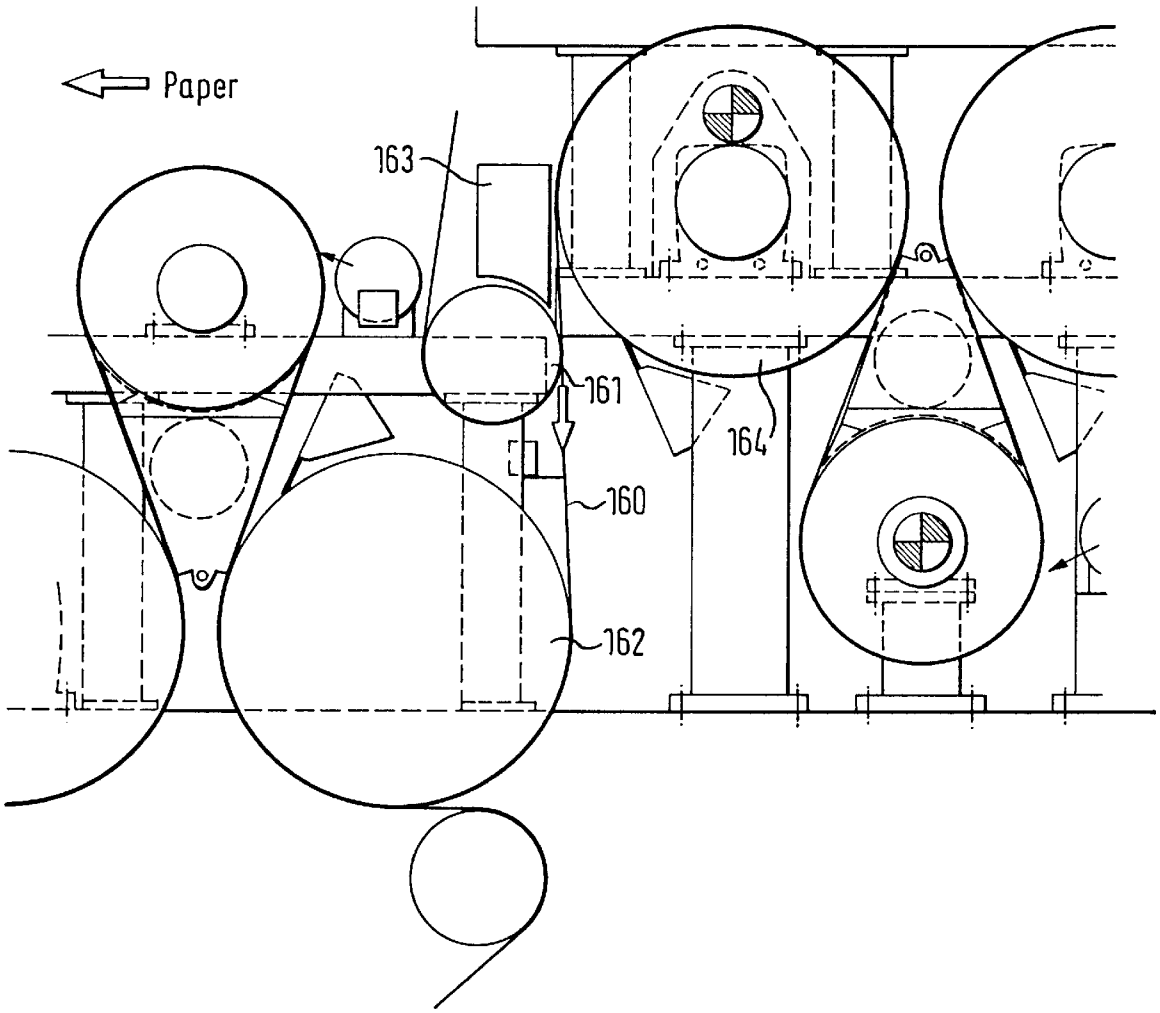
FIG. 7 shows a transfer between a top and bottom felted dryer group as shown in FIG. 6 on a larger scale.

In the dryer groups I, II, IV, VII and VIII, the drying cylinders 10 are above the adjacent, alternate in the web path, reversal rolls 11 so that within these dryer groups, only the bottom side of the paper web comes into direct contact with the drying cylinders 10. The top side of the web rides on the outside of the support belt 12 around the rolls 11. In dryer groups III, V and VI, the drying cylinders 10 lie below the reversal rolls 11 so that the opposite top side of the web comes into contact with the drying cylinders 10. Between top felted dryer groups and bottom felted dryer groups, all separation places between two adjacent dryer groups are developed as turn over or web side reversal separation places. At all of these turn over separation places, the web of paper travels over a free path of travel or open draw from the web support belt 12 of the preceding dryer group to the web support belt 22 of the following dryer group. Here, all separation places are developed as open separation places. In FIG. 6 the open draw is approximately three feet, however, the open draw can preferably vary from about six inches to about four feet. In a preferred embodiment as shown in FIG. 6, no rolls other than guide rolls are placed at the open drawer transfer. However, vacuum rolls, blow boxes, vacuum boxes and other devices which assist in transferring the web between dryer groups can be used. Furthermore, it is possible to change the distance of the open draw by making either or both rolls 161 or 165 moveable, as shown in FIG. 7. The distance of the open draw could be decreased during threading and increased during normal operation of the paper machine. The distance of the open draw can be varied according to the type of paper and moisture content of the paper.

In a further embodiment, as shown in FIG. 6 the dryer groups in the initial, or upstream or wetter region of the dryer section are top felted, and therefore, only the lower side of the web comes into contact with the drying cylinders 10. FIG. 6 shows a more even distribution of top felted and bottom felted dryer groups than FIG. 1. Although top felted dryer groups are preferred as described above, a mix of top felted and bottom felted dryer groups assist in curl control in the main dryer section. FIG. 6 shows that in dryer groups, I, II, IV, VII and VIII, the drying cylinders 10 all lie above the neighboring reversing rolls 11 with which the dryer cylinders, 10, alternate along the web path. Dryer groups III, V and VI have a reverse arrangement in which the drying cylinders 10 lie below the reversing rolls 11 so that the top side of the paper web comes into direct contact with the drying cylinders 10 of that group. The reversing rolls 11 as shown in FIG. 6 are perforated cylinders, but can be grooved rolls. Between the dryer cylinders 10 and above the reversal rolls 11 in dryer groups I, II, IV, VII and VIII is located a pressure differential box 14. Between the dryer cylinders 10 and below reversal rolls 11 in dryer groups III, V and VI is located a pressure differential box 14. This is preferably a Duostabilizer or vacuum box, however, other pressure differential boxes, such as blow boxes may also be used. Also a box having no means of creating a pressure differential, but which can divert the air currents associated with the movements of the web, can also be placed in the pocket.

Accordingly, between each two dryer groups of dryer groups I and II, V and VI and VII and VIII, there are only so called "simple" places of separation between the adjacent dryer groups. This means that the web support belt 22 of the next following succeeding dryer group contacts the last drying cylinder 10 of the preceding dryer group at a place where the web of paper is no longer covered by the web support belt 12 of the preceding dryer group. Such a known development of the place of separation is advantageous in two respects. The threading of the web of paper, for instance upon the starting of the paper machine operation or after a tear of the paper web, takes place completely automatically, without rope guidance being necessary, as is required in older arrangements. The web of paper travels just as reliably during the normal operation of the dry end from each preceding dryer group to the following dryer group. In an exceptional case and despite the favorable manner of construction described above, if a tear should take place in the web of paper, then the reject paper or broke moves readily downward from ALL drying cylinders 10 of the dryer groups into the basement provided below the dry end.

Figure 8:
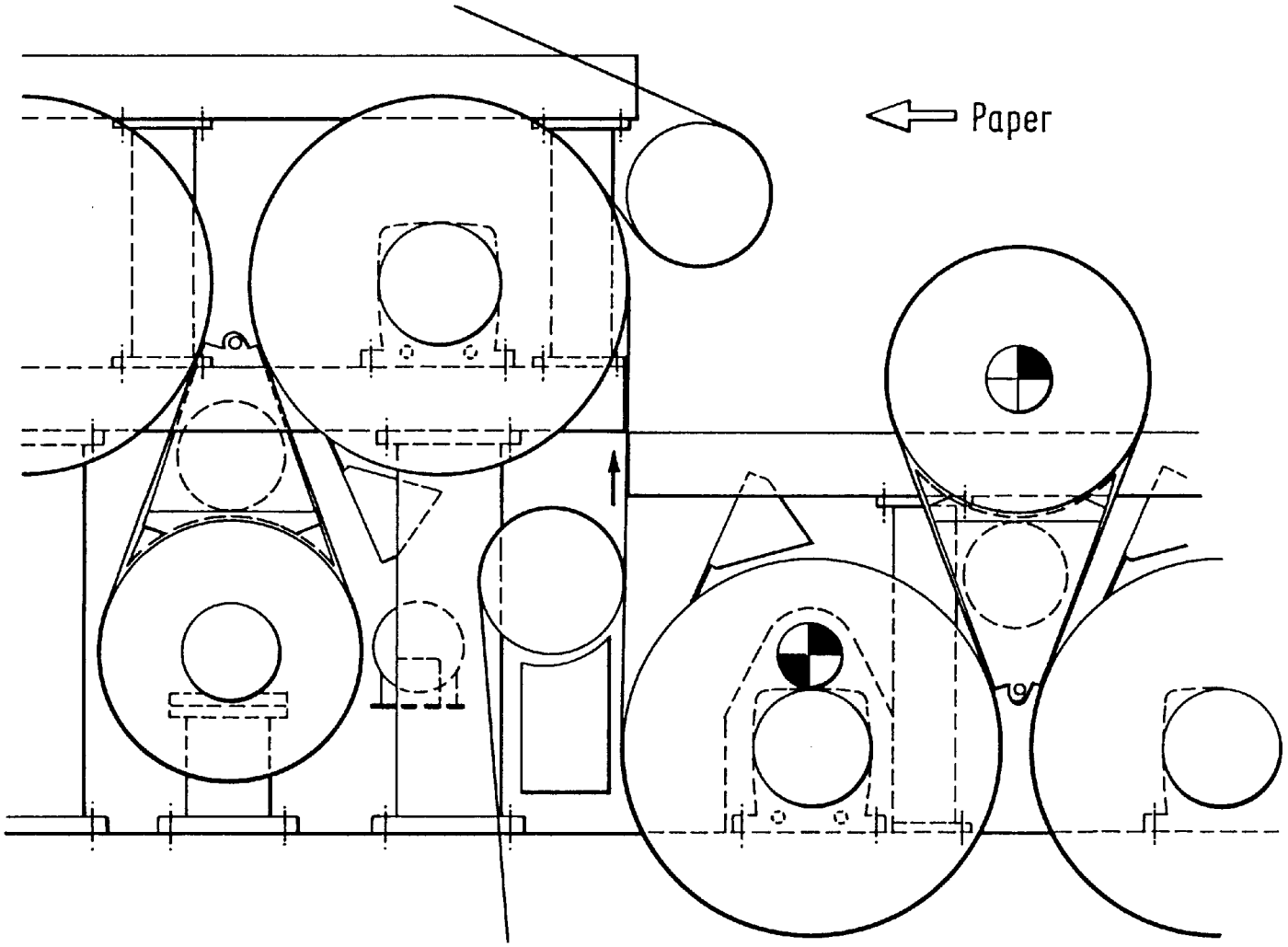
FIG. 8 shows a transfer between a bottom and top felted dryer group as shown in FIG. 6 on a larger scale.
Figure 9:
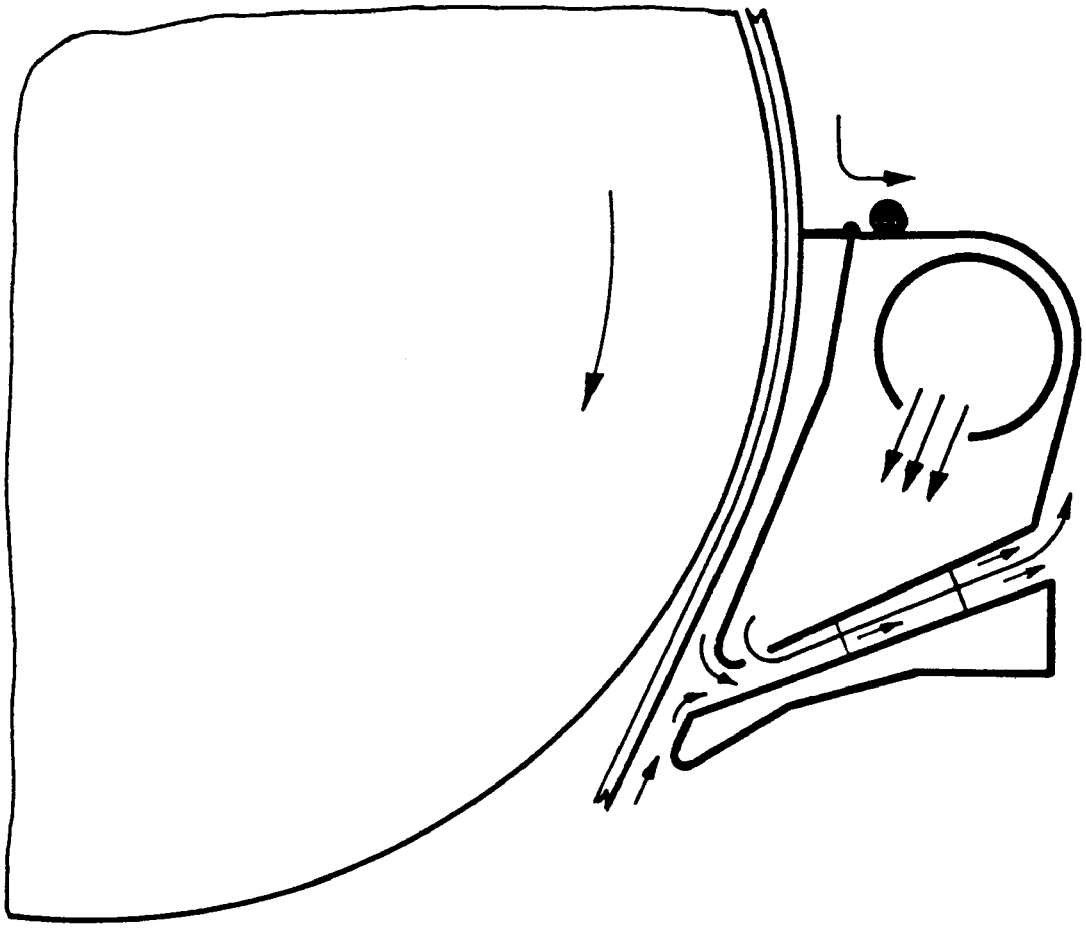
FIG. 9 shows an example of a pressure differential device.

FIGS. 7 and 8 show an enlarged view of FIG. 6 at the transfers between the top-felted single tier dryer groups and the bottom felted single tier dryer groups. There is an open draw transfer between the dryer groups II and III, III and IV, IV and V and VI and VII as shown in FIG. 6. The web 160 is totally unsupported between the guide roll 161 and dryer cylinder 162. A pressure differential device 163 as illustrated in FIG. 9 is placed above guide roll 161 in FIG. 7. The function of pressure differential device 163 is to assist in pulling the web off dryer cylinder 164. Dryer cylinder 164 being a heated surface tends to create an adhesion which tends to hold the web to the cylinder surface. The pressure differential device 163 creates a vacuum which pulls the web off the dryer cylinder.

Figure 10:
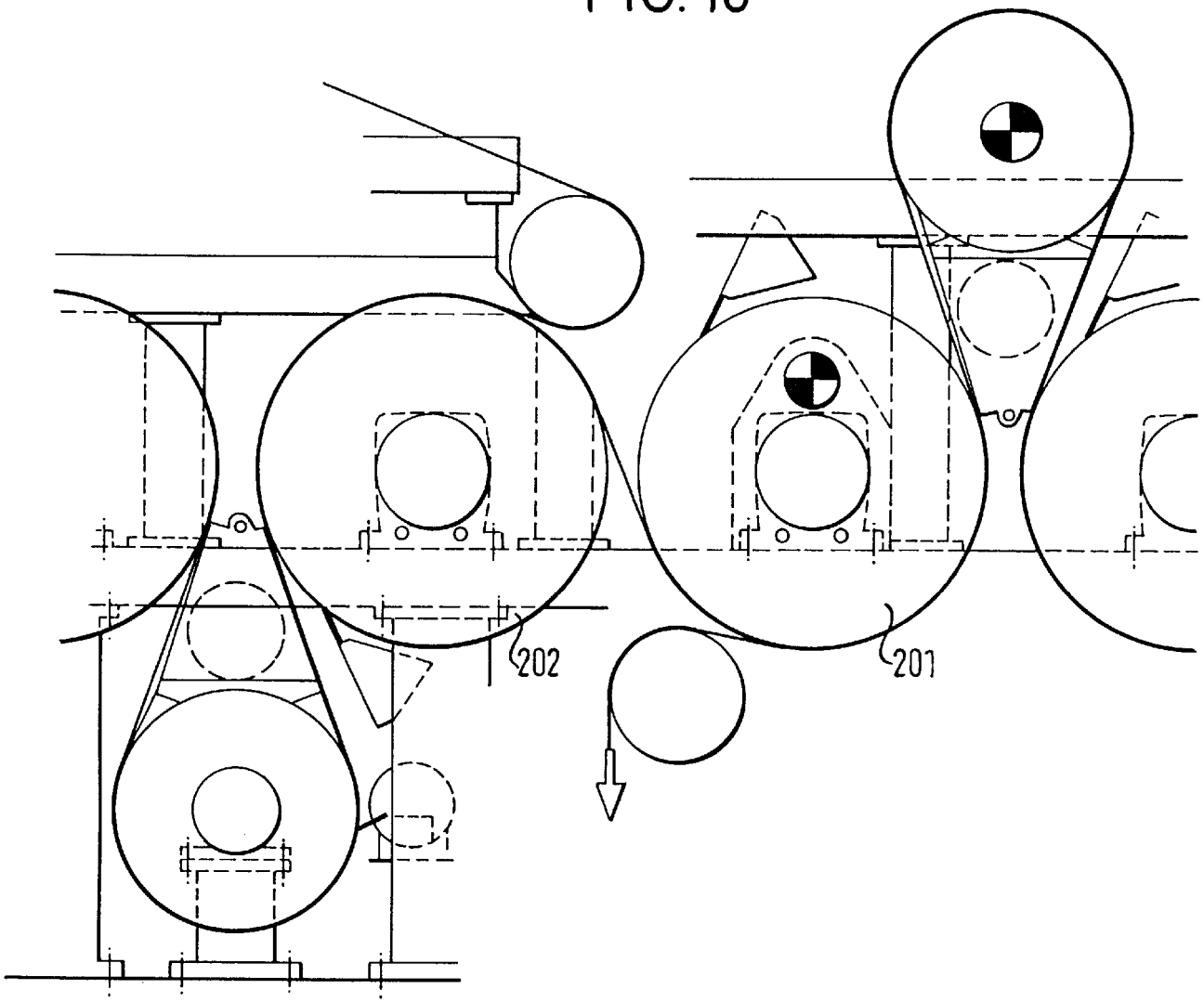
FIG. 10 shows a transfer between a bottom and top felted dryer group.

FIG. 10 shows a transfer arrangement between a bottom felted dryer group and a top felted dryer group where the web is transferred from the last dryer cylinder 201 in the bottom felted dryer group to the first dryer cylinder 202 in the top felted dryer group. In a preferred embodiment, the two dryer groups would be on the same plane. It is also preferred that the distance between the last dryer cylinder in the bottom felted dryer group and the first cylinder in the top dryer group be small enough so as to create minimal flutter of the web, but large enough so that there is no danger of contact between the two dryer cylinders and so that the broke can fall between the dryer cylinder 201 and 202 if there is a break in the web. In this embodiment there are no rolls at the transfer, including guide rolls.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A machine for manufacturing a paper web, the machine including a dry end comprising a plurality of dryer groups arranged one after the other along the path of the web through the dry end; each dryer group comprising: a single row of heatable drying cylinders; a reversal roll between each two drying cylinders in the group; an endless, web support belt which supports the web to travel together with the support belt through the dryer group; guide rolls in each dryer group for guiding the support belt in an endless loop through the respective dryer group;

the support belt passing through the dryer group in a meander path so that the web on the support belt directly contacts a drying cylinder in the respective dryer group, the support belt then touching a reversal roll in sequence and the web then touching the next drying cylinder in sequence so that the web comes into direct contact with the drying cylinders and the support belt comes into direct contact with the reversal rolls;

at least one of said dryer cylinders in said dryer groups having a pressure differential box; said pressure differential box being on the down run of a web path where said web leaves said dryer cylinder; wherein said pressure differential box assists in removing said web from said dryer cylinder.

2. The machine according to claim 1, wherein one of said dryer groups is a top-felted dryer group wherein a pressure differential box is located between the dryer cylinders and above the respective reversal rolls;

a second dryer group is located immediately downstream from said top-felted dryer group;

said second dryer group being a bottom felted dryer group wherein a pressure differential box is located between the dryer cylinders and below the reversal rolls;

an open draw transfer between said first dryer group and said second dryer group and a pressure differential device is used to assist in pulling the web off a final dryer cylinder within a dryer group prior to said open draw.

3. The machine of claim 1, wherein for at least one of the dryer groups include a guide roll within the support belt which is supported for being moveable in a manner in which a separation place between two dryer groups can be operated optionally opened for providing a space where a web runs unsupported from a preceding dryer group to a following dryer group or closed where support belts of two dryer groups are in contact and a web is supported in its movement across the separation place.

4. The machine of claim 1 wherein the diameter of the reversal rolls is less than half of the diameter of the dryer cylinders.

5. The dryer section of claim 1 wherein the number of top felted dryer groups is greater than the number of bottom felted dryer groups and curl is controlled within said dryer section.

6. The dryer section of claim 1 including respective drive means for driving the reversal rolls in each of the dryer groups to rotate causing the web to move through the dryer group; each of the drive means for each of the dryer groups having a drive which is adapted to produce a selectively variable rotation speed for the reversal rolls in that dryer group, and a respective speed control device for the reversal rolls of each of the dryer groups for enabling adjustment to produce a difference in rotation speeds between the drying cylinders of adjacent dryer groups.

7. The machine of claim 1, wherein the drying cylinders, the reversal rolls and the guide means of the second to last dryer group in the path of the web through the dry end are so placed that the drying cylinders of the second to last dryer group lie below the respective reversal rolls of the second to the last dryer group such that only the top side of the web contacts the drying cylinders in that group, while the dryer cylinders, the reversal rolls and the guide means of all of the other dryer groups are so placed that the drying cylinders of all of the other dryer groups are arranged above the reversal rolls of all of the other dryer groups.

8. The machine of claim 1, wherein there is an open draw both preceding and following the second to last dryer group; said open draw being defined as the web being not supported by any support belt as it moves to and then away from the second to last dryer group.

9. The machine of claim 1 wherein the diameter of the reversal rolls is less than the diameter of the dryer cylinders.

10. The machine of claim 1 wherein the web is transferred in said open draw directly from the last dryer cylinder of a dryer group that dries a first side of a web to a first dryer cylinder of a dryer group that dries an opposite side of said web; said transfer having no reversal rolls between said dryer cylinders.

11. The machine of claim 1 wherein the open draw transfer is directly from the last dryer cylinder of a dryer group that dries a first side of a web to a first dryer cylinder of a dryer group that dries an opposite side of said web; said transfer having no rolls between said dryer cylinders.

12. The machine of claim 11 wherein a pressure differential box is located between the dryer cylinders and above the respective reversal rolls for each dryer cylinder within a dryer group for at least 70% of the dryer groups.

13. The machine of claim 11 wherein a pressure differential box is located between the dryer cylinders and above the respective reversal rolls for each dryer cylinder within a dryer group for 100% of the dryer groups.

14. The machine of claim 11 wherein all of said separation places are placed in an open position.

15. The machine of claim 11 wherein all of said separation places are placed in a closed position.

16. The machine of claim 11 wherein in a wet end of said plurality of dryer groups said separation places are placed in a closed position.

17. The machine of claim 11, wherein for at least one of the dryer groups a guide roll within the support belt is supported for being moveable in a manner in which the separation place can be operated optionally opened for providing a space where a web runs unsupported from the preceding dryer group to the following dryer group or closed where the support belts of two dryer groups are in contact and a web is supported in its movement across the separation place.

18. The dry end of the machine according to claim 1, wherein the respective drying cylinders, reversal rolls and guide rolls of each of the dryer groups are placed so as to define a respective separation place between each preceding dryer group and the succeeding dryer group thereafter in the path of the web through the dry end, a transfer of the web occurring at the separation place from the preceding dryer group to the succeeding dryer group;

the drying cylinders and the reversal rolls in all of the plurality of the dryer groups are so placed that the drying cylinders are above the reversal rolls such that only the bottom side of the web contacts the drying cylinders.

19. A machine for manufacturing a paper web, the machine including a dry end comprising a plurality of dryer groups arranged one after the other along the path of the web through the dry end; each dryer group comprising: a single row of heatable drying cylinders; a reversal roll between each two drying cylinders in the group; an endless, web support belt which supports the web to travel together with the support belt through the dryer group; guide rolls in each dryer group for guiding the support belt in an endless loop through the respective dryer group;

the support belt passing through the dryer group in a meander path so that the web on the support belt directly contacts a drying cylinder in the respective dryer group, the support belt then touching a reversal roll in sequence and the web then touching the next drying cylinder in sequence so that the web comes into direct contact with the drying cylinders and the support belt comes into direct contact with the reversal rolls;

one of said dryer groups being a top-felted dryer group wherein a pressure differential box is located between the dryer cylinders and above the respective reversal rolls;

a second dryer group located immediately downstream from said top-felted dryer group;

said second dryer group being a bottom felted dryer group wherein a pressure differential box is located between the dryer cylinders and below the reversal rolls;

an open draw transfer between said first dryer group and said second dryer group and a pressure differential device is used to assist in pulling the web off a final dryer cylinder within a dryer group prior to said open draw.

* * * * *